United States Patent [19]

Banerjee et al.

[11] Patent Number: 4,827,950

[45] Date of Patent: May 9, 1989

[54] METHOD FOR MODIFYING A SUBSTRATE MATERIAL FOR USE WITH SMOKING ARTICLES AND PRODUCT PRODUCED THEREBY

[75] Inventors: Chandra K. Banerjee, Pfafftown; Deborah C. Kay, Lewisville, both of N.C.; Richard L. Lehman, Belle Mead, N.J.

[73] Assignee: R. J. Reynolds Tobacco Company, Winston-Salem, N.C.

[21] Appl. No.: 891,073

[22] Filed: Jul. 28, 1986

[51] Int. Cl.[4] ..... A24B 1/00

[52] U.S. Cl. ..... 131/335; 131/342; 131/359

[58] Field of Search ..... 131/336, 335, 342, 331; 423/628, 445, 245, 460; 502/415; 208/216 PP

[56] References Cited

U.S. PATENT DOCUMENTS

| | | | |
|---|---|---|---|
| T901,024 | 8/1972 | Sloan et al. | 131/336 |
| 2,063,014 | 12/1936 | Allen . | |
| 2,108,860 | 2/1938 | Kaufman . | |
| 2,773,842 | 12/1956 | Kimberlin et al. | 423/628 |
| 2,907,686 | 10/1959 | Siegel . | |
| 3,106,210 | 10/1963 | Reynolds et al. . | |
| 3,236,244 | 2/1966 | Irby et al. . | |
| 3,258,015 | 6/1966 | Ellis . | |
| 3,356,094 | 12/1957 | Ellis . | |
| 3,516,417 | 6/1970 | Moses . | |
| 3,584,630 | 6/1971 | Inskeep et al. . | |
| 3,931,824 | 1/1976 | Miano . | |
| 3,943,941 | 3/1976 | Boyd . | |
| 3,950,507 | 4/1976 | Kostantinovich et al. | 423/628 |
| 3,972,335 | 8/1976 | Tiggelbeck . | |
| 4,008,723 | 2/1977 | Borthwick . | |
| 4,044,777 | 8/1977 | Boyd . | |
| 4,075,156 | 2/1978 | Johnson | 423/445 |
| 4,079,742 | 3/1978 | Rainer . | |
| 4,097,656 | 6/1978 | Dany et al. | 423/445 |
| 4,284,089 | 8/1981 | Ray . | |
| 4,286,604 | 9/1981 | Ehretsmann . | |
| 4,326,544 | 4/1982 | Hardwick . | |
| 4,340,072 | 7/1982 | Bolt . | |
| 4,474,191 | 10/1984 | Steiner . | |
| 4,528,281 | 7/1985 | Sutt, Jr. . | |

FOREIGN PATENT DOCUMENTS

| | | |
|---|---|---|
| 117355 | 9/1984 | European Pat. Off. . |
| 0174645 | 3/1986 | European Pat. Off. . |
| 23237 | 7/1986 | Iran . |
| 13985/3890 | 9/1985 | Liberia . |

OTHER PUBLICATIONS

Tobacco Substitutes, Noyes Data, (1976).

*Primary Examiner*—V. Millin

*Attorney, Agent, or Firm*—Grover M. Myers; David G. Conlin

[57] ABSTRACT

The present invention relates to a substrate material having a decreased retentive capacity for use as a carrier for aerosol forming materials in smoking articles which smoking articles are capable of producing substantial quantities of aerosol, both initially and over the useful life of the product, without significant thermal degradation of the aerosol former and without the presence of substantial pyrolysis or incomplete combustion products or sidestream aerosol. Thus, the substrate material of the present invention when used with preferred smoking articles is able to provide the user with the sensations and benefits of cigarette smoking without burning tobacco. In addition, the article may be made virtually ashless so that the user does not have to remove any ash during use.

Preferred smoking articles which employ the substrate material of the present invention have a short combustible carbonaceous fuel element, alumina or carbon substrate modified in accordance with the present invention bearing an aerosol forming substance, an efficient insulating means, and a relatively long mouth end piece. The fuel element is provided with a plurality of longitudinally extending passageways which act to control the heat transferred from the burning fuel element to the aerosol generating means, thus preventing the thermal degradation of the aerosol former.

27 Claims, 1 Drawing Sheet

METHOD FOR MODIFYING A SUBSTRATE MATERIAL FOR USE WITH SMOKING ARTICLES AND PRODUCT PRODUCED THEREBY

BACKGROUND OF THE INVENTION

The present invention relates to a substrate material having a decreased retentive capacity for use as a carrier for aerosol forming materials in smoking articles, to methods of preparing the substrate material as well as to smoking articles employing the substrate material. Such substrate materials having a decreased retentive capacity are especially useful in making smoking articles that produce an aerosol resembling tobacco smoke, but which contain no more than a minimal amount of incomplete combustion or pyrolysis products.

Cigarette-like smoking articles have been proposed for many years, especially during the last 20 to 30 years. See for example, U.S. Pat. No, 4,079,742 to Rainer et al; U.S. Pat. No. 4,284,089 to Ray; U.S. Pat. No. 2,907,686 to Siegel; U.S. Pat. No. 3,356,094 to Ellis et al.; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; U.S. Pat. No. 4,474,191 to Steiner; and European Patent Appln. No. 117,355 (Hearn).

Many such smoking articles have been based on the generation of an aerosol or a vapor. Some of these products purportedly produce an aerosol without heat. Others have used a heat or fuel source in order to produce an aerosol. However, none of these articles have ever achieved any commercial success, and it is believed that none have ever been widely marketed. The absence of such smoking articles from the marketplace is believed to be due to a variety of reasons, including insufficient aerosol generation, both initially and over the life of the product, poor taste, off-taste due to the thermal degradation of the aerosol former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention is directed to a substrate material having a decreased retentive capacity for use as a carrier for aerosol forming materials in smoking articles, to methods of preparing such substrate material for use in such articles as well as to smoking articles employing the substrate material. Smoking articles which employ the substrate material of the present invention are capable of producing substantial quantities of aerosol, both initially and over the useful life of the product, without significant thermal degradation of the aerosol former and without the presence of substantial pyrolysis or incomplete combustion products or sidestream smoke. Moreover, they provide the user with the sensations and benefits of cigarette smoking without the necessity of burning tobacco.

The substrate materials of the present invention may be virtually any porous material capable of retaining an aerosol former and releasing a potential aerosol forming vapor upon heating by the fuel and which have a decreased retentive capacity. The preferred substrate materials of the present invention are alumina and activated carbon which are modified to have a decreased retentive capacity.

Modification of substrate materials in accordance with the present invention generally decreases the surface area and increases the median pore diameter (volume) of the substrate material which results in the substrate having a decreased retentive capacity for the aerosol former, which, in turn, helps minimize off-taste present in smoking articles.

As used herein, the term "retentive capacity" is used to define the binding ability of the substrate material for the aerosol former and/or flavor agents by means of physical and/or chemical forces.

The preferred process of modifying such substrate materials comprises the sequential steps of:

(a) heating the substrate material for a period sufficient to decrease the retentive capacity of the substrate material for the aerosol former;

(b) washing the heat-treated substrate material to remove contaminants present or generated during heating; and (c) drying the treated substrate material to a moisture content less than about 5%.

In general, smoking articles utilizing the modified substrate material prepared in accordance with the present invention include (1) a fuel element; (2) a physically separate aerosol generating means including the modified substrate material as a carrier for the aerosol former; and (3) an aerosol delivery means such as a longitudinal passageway in the form of a mouth end piece.

DETAILED DESCRIPTION OF THE PREFERRED EMBODIMENTS

Figure 1:
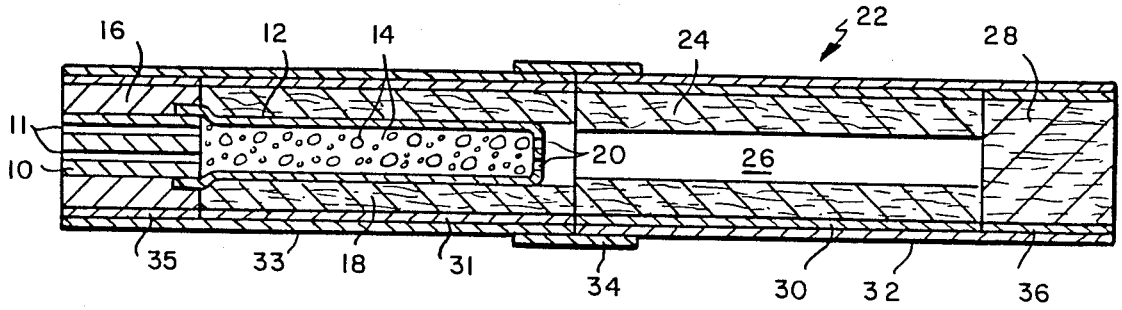
FIG. 1 is a longitudinal view of a preferred smoking article which may employ the treated substrate material of the present invention.

In general, the preferred process of modifying the substrate material in accordance with the present invention comprises heating the material for a period of time sufficient to decrease its retentive capacity for the aerosol former and/or flavor agents employed in the smoking article. Other methods of physico-chemically altering the substrate material in order to decrease its retentive capacity may also be employed.

Useful substrate materials which may be employed in practicing the present invention have a decreased retentive capacity, are porous, and must be capable of retaining aerosol forming materials (such as glycerin, triethylene glycol and the like and other components such as comminuted tobacco, spray dried tobacco extract, tobacco extract, and the aerosol forming materials) and releasing a potential aerosol forming vapor upon heating by the fuel. Such materials which may be modified to have a decreased retentive capacity include aluminas, porous grade carbons, activated carbons, and the like. Other suitable materials which may be modified in accordance with the present invention include silicas, clays such as vermiculite or bentonite, other inorganic oxides, sulfates, carbonates, carbides and the like, said materials having a median pore diameter greater than about 0.05 microns. Activated carbon and alumina substrates are preferred.

In one preferred embodiment alumina is modified to reduce its retentive capacity. Alumina substrates useful in practicing the present invention may be in various forms including porous monolithic solids, granular or extruded materials, fine powders or fibers. Especially useful substrate aluminas which may be modified for use in preferred smoking articles are available from the W.R. Grace Co. as high surface area, SRA070 6×14 U.S. mesh. Other aluminas which may be used include calcined alumina CP-5, CP-2, CPN available from Alumina Company of America, Pittsburgh, Pa. and activated alumina A-2 and A-201, available from Kaiser Chemical, Baton Rouge, La.

In accordance with the present invention, alumina is modified to its alpha form (e.g., from gamma to alpha) before use in smoking articles by heating, e.g. sintering, at elevated temperatures, e.g., greater than 1000° C., and preferably by washing, and drying. The overall heating time and temperature will depend, at least in part, upon the nature of the substrate material being treated, the form of the substrate material, e.g., particulate or solid, the amount of material being treated, the packing of such material within the heating means, the nature of the volatiles present, and the like.

Preferably, the alumina is heated at a rate of about 200° to 500° C. per hour, most preferably at about 400° C. per hour, to a temperature above 1000° C., most preferably from about 1200° to 1550° C. Preferably, heating is carried out in air although a nonoxidizing atmosphere may be employed. The alumina is held at the temperature for an extended period of time, preferably about one hour depending on the temperature employed. The substrate is then cooled to room temperature. The preferred heating means is a gas fired Osciplate furnace (Harrop Industries, Colombus, Ohio). While not wishing to be bound by theory it is believed that gas fired furnaces provide higher moisture during heating of alumina which affects its pore structure, e.g., provides coarser pores than furnaces having a low moisture content, e.g. electric furnaces.

The sintering process removes organic contaminants from the raw alumina, but a washing step is preferably employed to remove materials either generated, e.g. fines, or not eliminated by the sintering process. Typically deionized water and/or a protic organic solvent, e.g., ethanol, is used as the wash solvent. One or several washings may be required to remove such material.

After washing, the purified alumina is preferably dried to a moisture content less than about 5 weight percent, more preferably less than about 3 weight percent, more preferably less than about 1 weight percent. If a protic organic solvent such as ethanol is used, simple vacuum drying may be employed. If water or a mixture of water and a protic solvent is used, drying temperatures greater than 100° C., preferably greater than 200° C. can be employed.

The following Table (I) compares the physical characteristics of untreated, i.e. raw, alumina (sample 1) with alumina type substrates modified in accordance with the present invention (samples 2–4). Surface area was determined by the BET nitrogen adsorption method on a Micromeritics Digisorb 2600 (Micromeritics, Norcross, GA). Pore size measurements were determined by mercury intrusion on a Micromeritics Autopore 9200. The alumina of samples 2–4 were heated in a batch furnace in air at a rate of 400° C./hour to a temperature of 1450° C. and held at that temperature for about one hour. The heated alumina was cooled to room temperature and thereafter washed with deionized water. The modified alumina was then dried at about 400° C. to a final moisture content of less than about 1%.

TABLE I

PHYSICAL CHARACTERISTICS OF MODIFIED AND UNMODIFIED ALUMINA

| SAMPLE | SIZE US MESH | SURF. AREA $m^2/g$ | PORE AREA $m^2/g$ | MED. PORE DIA(VOL) (MICRONS) | INTRUSION VOL CC/G | RETENTION CAPACITY |
|---|---|---|---|---|---|---|
| 1 | 10 × 14 | 118 | 184.8 | 0.028 | 1.05 | 54 |
| 2 | 10 × 14 | 4 | 5.3 | 0.844 | 0.669 | — |
| 3 | 14 × 20 | 4 | 5.9 | 0.530 | 0.631 | — |
| 4 | 10 × 14 | 4 | 5.0 | 0.750 | 0.739 | 40 |

a. Retention Capacity was determined by saturating a known amount of substrate with glycerin, spinning at 1600 × G for 10 minutes and measuring the weight percent of glycerin retained by the substrate.
b. Median Pore Diameter (Volume) is the pore diameter at which equal quantities of pore volume occur at both larger and smaller diameters. Median Pore Diameter (Volume) was measured on a Micromeritics Autopore 9200.

As can be seen from Table I, alumina substrate modified in accordance with the present invention has a decreased retentive capacity i.e., a reduced surface area and increased pore diameter which is effected by sintering. It has been found that such changes in the physical characteristics of modified alumina help minimize or eliminate off-taste during smoking of articles employing the modified substrate.

In general, alumina substrate modified in accordance with the present invention should have a surface area ($m^2/g$) below about 50, preferably below about 30, and more preferably below about 10. The median pore diameter (volume, in microns) should be greater than about 0.1, preferably greater than about 0.3, and most preferably greater than about 0.5.

For use in certain preferred smoking articles the alumina substrate may be formed into rods. In certain embodiments, preferably prior to sintering, an extrudate of alumina is formed by admixing from about 80 to 10 weight percent, preferably about 70 to 20 weight percent, of unmodified powdered alumina with from 90 to 20 weight percent, preferably about 30 to 80 weight percent of a binder such as alumina monohydrate. Especially useful powdered aluminas are available from Alcan Chemical Products (Cleveland, Ohio) designated C-71-UNG. Suitable binders are available from Vista Chemical Co. (Houston, Tex.). In addition, a peptizing agent such as acetic acid is added in order to peptize the binder. Preferably, alumina and binder are blended in a dry state followed by the addition of an aqueous solution of the peptizing agent to form a paste having a stiff dough-like consistency.

The amount of peptizing agent added to the dry blend of alumina and binder will vary to some extent upon the proportion of binder being used. Generally, a sufficient amount should be added to bring the moisture content of the admixture to about 20 to 40 weight percent, preferably from about 25 to 35 weight percent, most preferably about 30 weight percent.

The dough is then extruded using a standard ram or piston type extruder into the desired shape, with the desired number of passageways (centrally and/or peripherally), and dried, preferably at room temperature to reduce the final moisture content to less than about 5 weight percent, preferably less than about 3 weight percent, most preferably less than about 1 weight percent. The outer diameter of the rod is preferably slightly less than the outer diameter of the aerosol generating means, e.g., such as the metallic container used in preferred smoking articles to contain the substrate material, infra. Preferably, there are thirteen passages provided in the extruded rod positioned close to the longitudinal axis thereof and having a diameter of approximately 0.022 inches. The material is then sintered as described above. The sintered rod is preferably cut to a length of about 10 mm and can be used in lieu of particulate substrate in smoking articles.

In another preferred embodiment, activated carbon is modified to reduce its retentive capacity. Activated carbons useful in practicing the present invention may also be in various forms including powdered, granular, extruded etc., although granular is preferred. Especially useful activated carbons include APC, DP-131, CAL, SGL, OL, BPL (all of which are available from Calgon Carbon Corporation, Pittsburgh, Pa.), GRC-11 and GRC-22 (Union Carbide Corp.), Darco (12×20) and H-85 (ICI Americas, Inc., Wilmington, DE).

Activated carbons as a substrate material offer many potential advantages when used as a carrier for aerosol formers in cigarette-type smoking articles. For example, activated carbons have a high porosity, are thermally stable and available with a wide range of characteristics. Moreover, it has been found that due to their high surface energies, activated carbons retain aerosol forming materials and/or flavor agents on the substrate for substantial periods of time without any significant migration to other parts of the smoking article. Thus, their retentive capacities are much higher than non-activated carbons.

The use of activated carbon per se as a carrier for aerosol forming materials in smoking articles is not without problems. As discussed below, due to the presence of active sites, capillary forces and/or other factors, it has been found that activated carbon binds aerosol forming materials too tightly. The binding forces at these sites may be so great that when subjected to heat during lighting and puffing of the smoking article an off-taste in the mainstream is produced. It has been found that activated carbon modified to have larger pores or smaller surface area is more desirable as a substrate. Physico-chemical modification in accordance with the present invention overcomes these problems while retaining the above advantages of using non-activated carbon as a carrier for aerosol forming materials.

The first step in the preferred process of modifying activated carbon is heating the material in a nonoxidizing atmosphere at a temperature above about 1000° C., preferably above about 1800° C., most preferably at about 2500° C. for a period of time sufficient to decrease its retentive capacity for the aerosol former. Temperatures above the point of transition to a graphite type material should be avoided, i.e., above 2700°. Graphitic materials, for example have been found to have insufficient binding forces to retain the aerosol former.

As used herein, the term "nonoxidizing atmosphere" is defined to include both inert atmospheres and vacuum conditions. Also included within this definition is the slightly oxidizing atmosphere created when moisture is driven from the unmodified substrate material upon initial heating inside a furnace.

The formation of a nonoxidizing atmosphere may be achieved through any of the means available to the skilled artisan. One such method involves the introduction of an inert gas, e.g., nitrogen, argon, and the like, to the oven. The use of such a gas may be either static, i.e., a closed system containing the gas, or it may be used as a sweep gas, i.e., where the gas stream passes through the oven during heating, carrying volatiles away as exhaust products. Preferably, nitrogen is employed in a static condition, usually at a slight positive pressure.

In certain preferred embodiments, it may be desirable to combine the heat modified activated carbon with tobacco dust, spray dried tobacco extract, tobacco extract, and the like. The addition of such materials to modified activated carbon is believed to further reduce the retentive capacity of the activated carbon by partially blocking or further modifying the remaining small pores and/or active sites.

As with the treatment of alumina, a washing process is preferably employed to remove contaminants either generated by or remaining after heating. Deionized water and/or a protic solvent may used as the washing solvent. Deionized water is preferred.

After washing, the heat-modified activated carbon is preferably dried to a moisture content less than about 5 weight percent, more preferably less than about 3 weight percent, most preferably less than about 1 weight percent.

Heat treatment of the activated carbon results in several modifications in the properties of the activated carbon. For example, when APC activated carbon (Calgon) was heat-modified at 2500° C. for about 1 hour, the surface area was drastically reduced from about 1400 $m^2/g$ to 30 $m^2/g$. The reduction in surface area is believed to reflect either a more orderly microcrystalite structure and/or a coalescence of smaller pores into larger pores. With this loss in surface area, there was a simultaneous reduction in loading and holding capacities. The loss in loading and holding capacity of unmodified APC and APC modified at 1700° C. and 2500° C. for about 1 hour is illustrated in Table II.

TABLE II

| SUBSTRATE | TREATMENT | LOADING CAPACTIY (Weight Percent) | HOLDING CAPACITY (Weight Percent) |
|---|---|---|---|
| APC | None | 56.5 | 53.3 |
| APC | 1700° C. | 49.0 | 45.4 |

TABLE II-continued

| SUBSTRATE | TREATMENT | LOADING CAPACTIY (Weight Percent) | HOLDING CAPACITY (Weight Percent) |
|---|---|---|---|
| APC | 2500° C. | 41.7 | 37.9 |

a. Loading capacity was determined by saturating a known amount of substrate with the aerosol former, spinning at 100 × G for 10 minutes and measuring the weight percent of the aerosol former retained by the substrate.
b. Holding capacity was determined by incubating the centrifuged substrate at room temperature on absorbent paper in a closed container for 4 days and thereafter measuring the weight percent of the aerosol former retained by the substrate.

In general, activated carbon substrate modified in accordance with the present invention should have a surface area ($m^2/g$) below about 200, preferably below about 50, and most preferably below about 30.

Thus, it has been found that the degree of surface area reduction may be accomplished in a controlled manner by the extent of thermal treatment of the activated carbon depending upon the particular properties required of the modified substrate. For example, the amount of heat transferred from the fuel element to the substrate will affect the amount of surface area reduction necessary to achieve the desired results of the present invention, i.e., the more heat transferred to the modified substrate, the greater the reduction in surface area required to prevent undesirable off-taste during smoking.

While not preferred, another approach to physically or chemically modifying activated carbons is the addition of materials which modify and/or block the active sites or small pores having high surface activity. Such modifications substantially improve the performance of activated carbons as a substrate by minimizing or eliminating the off-taste. In general, the approach is to block the very small micropores and/or inactivate the active sites that have a high binding energy for the aerosol former or flavor molecules. Such materials useful in practicing the present invention include tobacco extract, corn syrup, fructose, ethyl cellulose and the like.

The process of modifying activated carbon with such materials generally comprises admixing the material with activated carbon in an appropriate solvent. The amount of material depends on the nature of the material employed. When tobacco extract is employed, it has been found that 1 to 10 weight percent of tobacco extract to activated carbon significantly reduces the off-taste. Fructose may be employed from about 5 to 40 weight percent, and ethyl cellulose from about 0.5 to 5 weight percent. Water is a preferred solvent for all of the above blocking materials save ethyl cellulose. Ethyl alcohol is the preferred solvent when ethyl cellulose is employed. The use of ethyl cellulose is especially useful as a modifying material, due, at least in part, to its insolubility in water, which, it is believed, prevents aerosol forming materials such as glycerin from being absorbed into the pores which have been blocked.

The admixture is allowed to equilibrate for a time sufficient for the small pores to be modified and/or blocked. Preferably, the material is incubated at a temperature between 10° and 50° C. for about 5 to 60 minutes, more preferably at a temperature of about 21° C. for about 30 minutes. Thereafter the admixture is dried to have a final moisture content less than about 5%, preferably less than about 3%, most preferably less than about 1%.

While not wishing to be bound by theory, it is believed that off-taste in smoking articles employing unmodified substrate materials is due, at least in part, to the binding force which exists between the substrate material and the aerosol former. Tightly bound aerosol forming materials, such as glycerin, are more likely to produce undesirable off-taste upon smoking of the article. It has been found, for example, that unmodified activated carbon binds glycerin too tightly, either due to the number of active sites present on activated carbon or capillary forces resulting from the interaction of the aerosol former with the walls of the small pores characteristic of activated carbon. On the other hand, the use of porous grade carbon i.e., non-activated carbon, while not binding the aerosol former as tightly as activated carbon, results in the migration of the aerosol former to other components of the smoking article due to its relatively large pores and smaller surface area. Migration of the aerosol former, particularly to the fuel source, is believed to produce undesirable off-taste in the mainstream and undesirable aroma in the sidestream smoke.

Substrate material modified in accordance with the present invention overcomes such problems by decreasing the retentive capacity of the substrate material in a controlled manner so as to reduce off-taste due to tight binding or migration of the aerosol former to other components of the smoking article.

It is believed that substrate materials modified in accordance with the present invention undergo certain physico-chemical changes including changes in pore size and surface area and/or a decrease in the reactivity of the substrate material due to the removal of certain reactive groups containing sulfur, oxygen and the like. It is also believed that such physico-chemical changes help minimize or eliminate off-taste due to tightly bound aerosol formers, yet maintain sufficient binding energy to prevent migration of the aerosol former to other components of the article.

The overall heating time and temperature will depend, at least in part, upon the type and nature of the substrate material being modified. For example, the form of the substrate material, e.g., particulate or non-particulate, the amount of material being modified, the packing of such material within the heating means, the nature of the volatiles present, and the like, will each affect the temperature and heating time required to decrease the retentive capacity of the substrate to the degree necessary to minimize or eliminate off-taste produced during smoking.

Preferred cigarette-type smoking articles which may employ the modified substrate of the present invention are described in the following patent applications:

| Applicants | Serial No. | Filed |
|---|---|---|
| Sensabaugh et al. | 650,604 | September 14, 1984 |
| Shannon et al. | 684,537 | December 21, 1984 |
| Clearman et al. | 840,114 | March 14, 1986 |

the disclosures of which are hereby incorporated by reference.

One such preferred cigarette-type smoking article is set forth in FIG. 1 accompanying this specification.

Referring to FIG. 1 there is illustrated a cigarette-type smoking article having a small (about 4.5 mm diameter ×10 mm long) carbonaceous fuel element 10 with several passageways 11 therethrough, preferably about seven. This fuel element is formed from an extruded mixture of carbon (from carbonized paper), SCMC binder, $K_2CO_3$, and water, as described in the above referenced patent applications.

Overlapping the mouthend of the fuel element 10 is a metallic container 12, about 4.5 mm in diameter and about 30 mm in length. The container holds a substrate material 14 which at least in part may contain the alumina or carbon substrates of the present invention either in particulate form, or alternatively, in the form of a rod. In addition, the substrate includes at least one aerosol forming substance such as propylene glycol or glycerin.

The periphery of fuel element 10 in this article is surrounded by a jacket 16 of resilient insulating fibers, such as glass fibers, and container 12 is surrounded by a jacket of tobacco 18. The rear portion of container 12 is sealed and is provided with 2 slits 20, for the passage of the aerosol forming materials to the user.

At the mouth end of tobacco jacket 18 is situated a mouthend piece 22 comprised of a cellulose acetate cylinder 24 which provides aerosol passageway 26, and a low efficiency cellulose acetate filter piece 28. As illustrated, the article (or portions thereof) is overwrapped with one or more layers of cigarette papers 30–36.

Upon lighting the aforesaid embodiment, the fuel element burns, generating the heat used to volatilize the aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as was common in previous thermal aerosol articles.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder.

The aerosol generating means which includes the modified substrate material of the present invention and which carries one or more aerosol forming substances is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

The aerosol forming substance or substances used in the preferred smoking articles must be capable of forming an aerosol at the temperatures present in the aerosol generating means upon heating by the burning fuel element. The preferred aerosol forming substances are polyhydric alcohols, or mixtures of polyhydric alcohols. More preferred aerosol formers are selected from glycerin, triethylene glycol and propylene glycol.

The aerosol forming substance may be dispersed on or within the modified substrate material in a concentration sufficient to permeate or coat the material, by any known technique.

The heat conducting material employed as the container for the aerosol generating means is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve virtually any desired degree of heat transfer.

The insulating members employed in the preferred smoking articles are formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element.

The currently preferred insulating fibers are ceramic fibers,such as glass fibers. Preferred glass fiber are experimentals materials produced by Owens—Corning of Toledo, Ohio under the designations 6432 and 6437, which have softening points of about 650° C. Other suitable glass fibers are available from the Manning Paper Company of Troy, N.Y., under the designations, Manniglas 1000 and Manniglas 1200.

In the most preferred smoking articles, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the heat from the fire cone away from the mouth and fingers of the user, and provides sufficient time for the hot aerosol to cool before reaching the user.

Preferred mouth end pieces include the cellulose acetate tube of FIG. 1. Other preferred tubes include a shorter cellulose acetate tube in conjunction with a longer section of non-woven fibrous polypropylene which may also function as a filter tip for the smoking article. Other suitable mouthend pieces will be apparent to those of ordinary skill in the art.

The mouthend pieces of the invention may include an optional "filter" tip, which is used to give the article the appearance of the conventional filtered cigarette. Such filters include low efficiency cellulose acetate filters, non-woven fibrous polypropylene and hollow or baffled plastic filters, such as those made of polypropylene.

The entire length of the article, or any portion thereof, may be overwrapped with one or more layers of cigarette paper. Preferred papers at the fuel element end should not openly flame during burning of the fuel element. In addition, the paper should have controllable smolder properties and should produce a grey, cigarette-like ash.

The wet total particulate matter (WTPM) produced by preferred smoking articles has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., Mut. Res., 31: 347–364 (1975); Nagao et al., Mut. Res., 42: 335 (1977).

The use of the modified substrate material of the present invention in the construction of cigarette-like smoking articles will be further illustrated with reference to the following examples which will aid in the understanding of the present invention, but which is not to be construed as a limitation thereof. All percentages reported herein, unless otherwise specified, are percent by weight. All temperatures are expressed in degrees Celsius and are uncorrected.

EXAMPLE I

The smoking article illustrated in FIG. 1 was made in the following manner.

A. Fuel Source Preparation

Grand Prairie Canadian (GPC) Kraft paper (non-talc grade) made from hardwood and obtained from Buckeye Cellulose Corp., Memphis, TN, was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350 ° C. for 2 hours. The temperature of the furnace was then increased at 5° C. per hour to 750° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon (CGPC) had a tapped density of 0.6 g/cc and hydrogen plus oxygen level of 4%.

Nine parts of this carbon powder was mixed with one part of SCMC powder, $K_2CO_3$ was added at 1 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudate had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had a density of 0.85 g/cc, a diameter of 4.5 mm, and an out of roundness of approximately 3%.

The dry, extruded rod was cut into 10 mm lengths and seven 0.2 mm holes were drilled through the length of the rod in a closely spaced arrangement with a core diameter (i.e., the diameter of the smallest circle which will circumscribe the holes in the fuel element) of about 2.6 mm and spacing between the holes of about 0.3 mm.

B. Spray Dried Extract

Tobacco (Burley, Flue Cured, Turkish, etc.) was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°–230° C. and collecting the dried powder material at the outlet of the drier. The outlet temperature varied from about 82°–90° C.

C. Substrate Preparation

High surface area alumina (surface area=280 $m^2/g$) from W.R. Grace & Co. (designated SMR-14-1896), having a mesh size of from −8 to+14 (U.S.) was sintered at a soak temperature of about 1400° C. for about one hour and cooled. The surface area of the modified alumina was approximately 4.0 $m^2/g$. The alumina was washed with water and dried. The sintered alumina (640 mg) was further treated with an aqueous solution containing 107 mg of spray dried flue cured tobacco extract and dried to a moisture content of about 1 weight percent. This material was then treated with a mixture of 233 mg of glycerin and 17 mg of a flavor component obtained from Firmenich, Geneva, Switzerland, under the designation T69-22.

D. Assembly

The metallic containers for the substrate were 30 mm long spirally wound aluminum tubes obtained from Niemand, Inc., having a diameter of about 4.5 mm. Alternatively, a deep drawn capsule prepared from aluminum tubing about 4 mil thick (0.1016 mm), about 32 mm in length, having an outer diameter of about 4.5 mm may be used. One end of each of these tubes was crimped to seal the mouthend of the capsule. The sealed end of the capsule was provided with two slot-like openings (each about $0.65\times3.45$ mm, spaced about 1.14 mm apart) to allow passage of the aerosol former to the user. Approximately 170 mg of the modified alumina was used to fill each of the containers. After the metallic containers were filled, each was joined to a fuel element by inserting about 2 mm of the fuel element into the open end of the container.

E. Insulating Jacket

The fuel element—capsule combination was overwrapped at the fuel element end with a 10 mm long, glass fiber jacket of Owens-Corning 6437 (having a softening point of about 650° C.), with 4 wt. percent pectin binder, to a diameter of about 7.5 mm and overwrapped with P878-63-5 paper.

F. Tobacco Jacket

A 7.5 mm diameter tobacco rod (28 mm long) with a 646 plug wrap overwrap (e.g., from a non-filter cigarette) was modified with a probe to have a longitudinal passageway (about 4.5 mm diameter) therein.

G. Assembly

The jacketed fuel element - capsule combination was inserted into the tobacco rod passageway until the glass fiber jacket abutted the tobacco. The glass fiber and tobacco sections were overwrapped with Kimberly-Clark P878-16-2.

A cellulose acetate mouthend piece (30 mm long) overwrapped with 646 plug wrap, of the type illustrated in FIG. 1, was joined to a filter element (10 mm long)

also overwrapped with 646 plug wrap by, RJR Archer Inc. 8—0560-36 tipping with lip release paper.

The combined mouthend piece section was joined to the jacketed fuel element—capsule section by a small section of white paper and glue.

Other smoking articles have been made in the forgoing manner except that the fuel source is prepared without regrinding or drying the carbon powder slurry mixture. In such articles fuel elements are directly extruded from a stiff, dough-like paste prepared from the carbon powder mixture.

Smoking articles thus prepared produced an aerosol resembling tobacco smoke without the undesirable off-taste produced by similar articles employing untreated alumina.

EXAMPLE II

Smoking articles of the type illustrated in FIG. 1 were made utilizing an extruded alumina substrate material in the following manner.

An alumina hydrate binder (Catapal SB. Vista Chemical Co., Houston, Texas) was mixed with alumina from Alcan Chemical Products, Cleveland, Ohio (designated C-71-UNG) at a ratio of 60:40. Mixing was done in a roller mill for 4 hours. Peptizing of alumina was achieved by acetic acid treatment. In a muller the alumina hydrate and alumina substrate were mixed with aqueous 5% acetic acid to a 31% moisture content. The mix was held for 4 hours at room temperature in an airtight container. The mix was extruded in thin strands in a ram extruder using a Forney compression tester. Strands of several diameters were extruded. The extrudates were dried at room temperature and heated at a chamber temperature of 500° C. for 3 hours. Heating was done in less than one inch bed depth. Several of the extrudates were tested in smoking articles generally prepared as in Example I. The extrudates were loaded with 30 weight percent glycerin and inserted into the metallic capsule. When smoked, an appreciable amount of aerosol was produced in all puffs, however, several puffs produced an off-taste believed to be due to pyrolysis of glycerin.

The 500° C.-sintered material was further modified by sintering at 1300° C. for 1 hour to convert the alumina from its gamma to its alpha form. When smoked under similar conditions, it produced similar amounts of aerosol without any off-taste.

EXAMPLE III

APC activated carbon (Calgon) was heated at 2500° C. for one hour in a batch oven under a nitrogen atmosphere. Compared to the unmodified substrate, the heat modified APC produced a relatively low level of off-taste when loaded with about 40 weight percent glycerin and smoked in an article similar to that described in Example I.

EXAMPLE IV

About 50 g of the heat-modified APC of Example III was mixed with 75 ml. of aqueous extract of tobacco dust (prepared from 100 g of tobacco dust in 500 ml of water). After gentle and thorough mixing, the mixture was allowed to stand at room temperature for one hour and the liquid decanted and discarded. The tobacco modified substrate was then washed with several volumes of deionized water. The washed substrate was dried in a convection oven at 140° C. for one hour. The washing step removed a considerable amount of soluble material from the substrate. The heat modified substrate was used in smoking articles similar to those described in Example I and resulted in a significant improvement in taste. Under normal smoking conditions, the washed substrate did not produce any off-taste.

EXAMPLE V

One hundred grams of powdered tobacco were suspended in 500 ml of deionized water. The suspension was stirred on a magnetic stirrer for 30 minutes and centrifuged at 2800 rpm for 30 minutes. The pellet was discarded and the supernatant (tobacco extract) was stored in the refrigerator for future use. About 75 ml of this extract was added to 50 g of DP-131 (Calgon) and the suspension was allowed to stand for one hour. In some occasions, the incubation was continued overnight. The modified DP-131 was dried at 100° C. for 4–6 hours. In some cases, the treatment with the tobacco extract was repeated. The modified DP-131 was loaded with 50% (wet weight) glycerin and smoked in an article similar to that of FIG. 1. The tobacco extract treatment reduced the off-taste to a significant extent.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method for making a carbon substrate for use as a carrier for aerosol forming materials for smoking articles comprising decreasing the surface area of the carbon substrate to below about 200 $m^2/g$.

2. The method of claim 1, wherein the surface area is decreased to below about 30 $m^2/g$.

3. The method of claims 1 or 2, wherein said carbon substrate is activated carbon and said decrease in surface area is effected by heating the activated carbon substrate.

4. A method for making a carbon substrate for use as a carrier for aerosol forming materials for smoking articles comprising heating activated carbon in a nonoxidizing atmosphere to a temperature above about 1000° up to about 2700° C. for a period of time sufficient to reduce its surface area to below about 200 $m^2/g$.

5. The method of claim 4, comprising the further steps of washing the heated activated carbon to remove contaminants present or generated during heating and thereafter drying to a moisture content less than about 5%.

6. A smoking article comprising a substrate material carrying an aerosol forming material, said substrate having a median pore diameter greater than about 0.05 microns.

7. The smoking article of claim 6, wherein said substrate material is selected from the group of silicas, clays, oxides, sulfates, carbonates and carbides.

8. The smoking article of claim 7, wherein the said substrate material is heated prior to use to increase its median pore diameter.

9. A smoking article comprising an alumina substrate carrying an aerosol forming material, said alumina substrate having a surface area below about 50 $m^2/g$ and a median pore diameter greater than about 0.1 microns.

10. The smoking article of claim 9, wherein the surface area of the substrate is below about 30 $m^2/g$.

11. The smoking article of claim 10, wherein the surface area of the substrate is below about 10 $m^2/g$.

12. The smoking article of claim 9, 10 or 11, wherein the median pore diameter of the substrate is greater than about 0.3 microns.

13. The smoking article of claim 9, 10 or 11, wherein the median pore diameter of the substrate is greater than about 0.5 microns.

14. The smoking article of claim 9, 10 or 11, wherein said substrate is prepared by heating gamma alumina to a temperature above about 1000° up to about 1550° C. to decrease its retentive capacity prior to use.

15. A smoking article comprising a carbon substrate carrying an aerosol forming material, said carbon substrate having a surface area below about 200 $m^2/g$.

16. The smoking article of claim 10, wherein the surface area is below about 50 $m^2/g$.

17. The smoking article of claim 11, wherein the surface area is below about 30 $m^2/g$.

18. The smoking article of claim 15, 16 or 17, wherein said substrate is prepared by heating activated carbon in a nonoxidizing atmosphere to a temperature above about 1000° up to about 2700° C. to decrease its retentive capacity prior to use.

19. An aerosol bearing material for use in smoking articles comprising a substrate carrying an aerosol forming material, said substrate having a median pore diameter greater than about 0.05 microns.

20. The aerosol bearing material of claim 19, wherein said substrate material is selected from the group of silicas, clays, oxides, sulfates, carbonates and carbides.

21. The aerosol bearing material of claim 20, wherein said substrate material is heated prior to use to increase its median pore diameter.

22. A aerosol bearing substrate comprising an alumina substrate carrying an aerosol forming material, said alumina substrate having a surface area below about 50 $m^2/g$ and a median pore diameter greater than about 0.1 microns.

23. The aerosol bearing substrate of claim 22, wherein the surface area of the substrate is below about 30 $m^2/g$.

24. The aerosol bearing substrate of claim 22, wherein the surface area of the substrate is below about 10 $m^2/g$.

25. The aerosol bearing substrate of claim 22, 23 or 24, wherein the median bore diameter of the substrate is greater than about 0.3 microns.

26. The aerosol bearing substrate of claim 22, 23 or 24, wherein the median pore diameter of the substrate is greater than about 0.5 microns.

27. The aerosol bearing substrate of claim 12, 23 or 24, wherein said substrate is prepared by heating gamma alumina to a temperature above about 1000° up to about 1550° C. to decrease its retentive capacity prior to use.

* * * * *